US009315887B2

(12) United States Patent
Fushiwaki et al.

(10) Patent No.: US 9,315,887 B2
(45) Date of Patent: Apr. 19, 2016

(54) HIGH-STRENGTH HOT-DIP GALVANIZED STEEL SHEET AND METHOD FOR PRODUCING SAME

(75) Inventors: Yusuke Fushiwaki, Hiroshima (JP); Yoshiharu Sugimoto, Chiba (JP); Masahiro Yoshida, Chiba (JP); Yoshitsugu Suzuki, Hiroshima (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 13/260,851

(22) PCT Filed: Mar. 31, 2010

(86) PCT No.: PCT/JP2010/056287

§ 371 (c)(1), (2), (4) Date: Dec. 19, 2011

(87) PCT Pub. No.: WO2010/114174

PCT Pub. Date: Oct. 7, 2010

(65) Prior Publication Data

US 2012/0090737 A1 Apr. 19, 2012

(30) Foreign Application Priority Data

Mar. 31, 2009 (JP) ..... 2009-085199
Feb. 9, 2010 (JP) ..... 2010-026066

(51) Int. Cl.
*C23C 2/28* (2006.01)
*C21D 1/26* (2006.01)
(Continued)

(52) U.S. Cl.
CPC ... *C23C 2/28* (2013.01); *C21D 1/26* (2013.01); *C21D 9/46* (2013.01); *C21D 9/561* (2013.01); *C22C 38/02* (2013.01); *C22C 38/04* (2013.01);
(Continued)

(58) Field of Classification Search
CPC ..... C21D 1/26; C21D 9/46; C21D 9/561; C22C 38/04
USPC ..... 148/400, 533
See application file for complete search history.

(56) References Cited

U.S. PATENT DOCUMENTS

2009/0123651 A1* 5/2009 Okada ..... 427/319

FOREIGN PATENT DOCUMENTS

EP 1482066 12/2004
EP 2412842 2/2012
(Continued)

OTHER PUBLICATIONS

"7th International Conference on Zinc and Zinc Alloy Coated Steel Sheet," *Galvatech*, 2007, Proceedings, p. 404.
(Continued)

*Primary Examiner* — Kaj K Olsen
*Assistant Examiner* — Alexander Polyansky
(74) *Attorney, Agent, or Firm* — DLA Piper LLP (US)

(57) ABSTRACT

A method for producing a high-strength hot-dip galvanized steel sheet includes a steel sheet containing, in percent by mass, 0.01% to 0.18% of C, 0.02% to 2.0% of Si, 1.0% to 3.0% of Mn, 0.001% to 1.0% of Al, 0.005% to 0.060% of P, 0.01% or less of S, and the balance being Fe and incidental impurities, and a galvanized coating layer on each surface of the steel sheet with a coating weight of 20 to 120 g/m$^2$ per surface, in which, when the steel sheet is subjected to annealing and a hot-dip galvanizing treatment in a continuous hot-dip galvanizing line, the dew point of the atmosphere is controlled to −40° C. or lower in the annealing furnace temperature range of 750° C. or higher.

6 Claims, 1 Drawing Sheet

(51) Int. Cl.

| | |
|---|---|
| ***C21D 9/46*** | (2006.01) |
| ***C21D 9/56*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |
| ***C23C 2/12*** | (2006.01) |
| ***C23C 2/40*** | (2006.01) |
| *C21D 6/00* | (2006.01) |
| *B32B 15/01* | (2006.01) |
| *C21D 9/48* | (2006.01) |

(52) U.S. Cl.
CPC . *C22C 38/06* (2013.01); *C23C 2/02* (2013.01); *C23C 2/12* (2013.01); *C23C 2/40* (2013.01); *C21D 9/48* (2013.01); *C21D 2211/005* (2013.01)

(56) References Cited

FOREIGN PATENT DOCUMENTS

| | | | |
|---|---|---|---|
| JP | 2004-315960 | A | 11/2004 |
| JP | 2004-323970 | A | 11/2004 |
| JP | 2006-233333 | A | 9/2006 |
| JP | 2007-146242 | A | 6/2007 |
| JP | 2008-163388 | A | 7/2008 |
| JP | 2008156734 | | 7/2008 |
| WO | 2008084875 | | 7/2008 |

OTHER PUBLICATIONS

"Kinzodu Butsuri Kagadu," English translation of title: "Physical Chemistry of Metal," *The Japan Institute of Metals*, May 20, 1996, pp. 72-73, along with 1 sheet of partial English translation of main part of pp. 72-73.

Supplementary European Search Report dated Jun. 20, 2014 from corresponding EP Application No. 10758934.3.

* cited by examiner

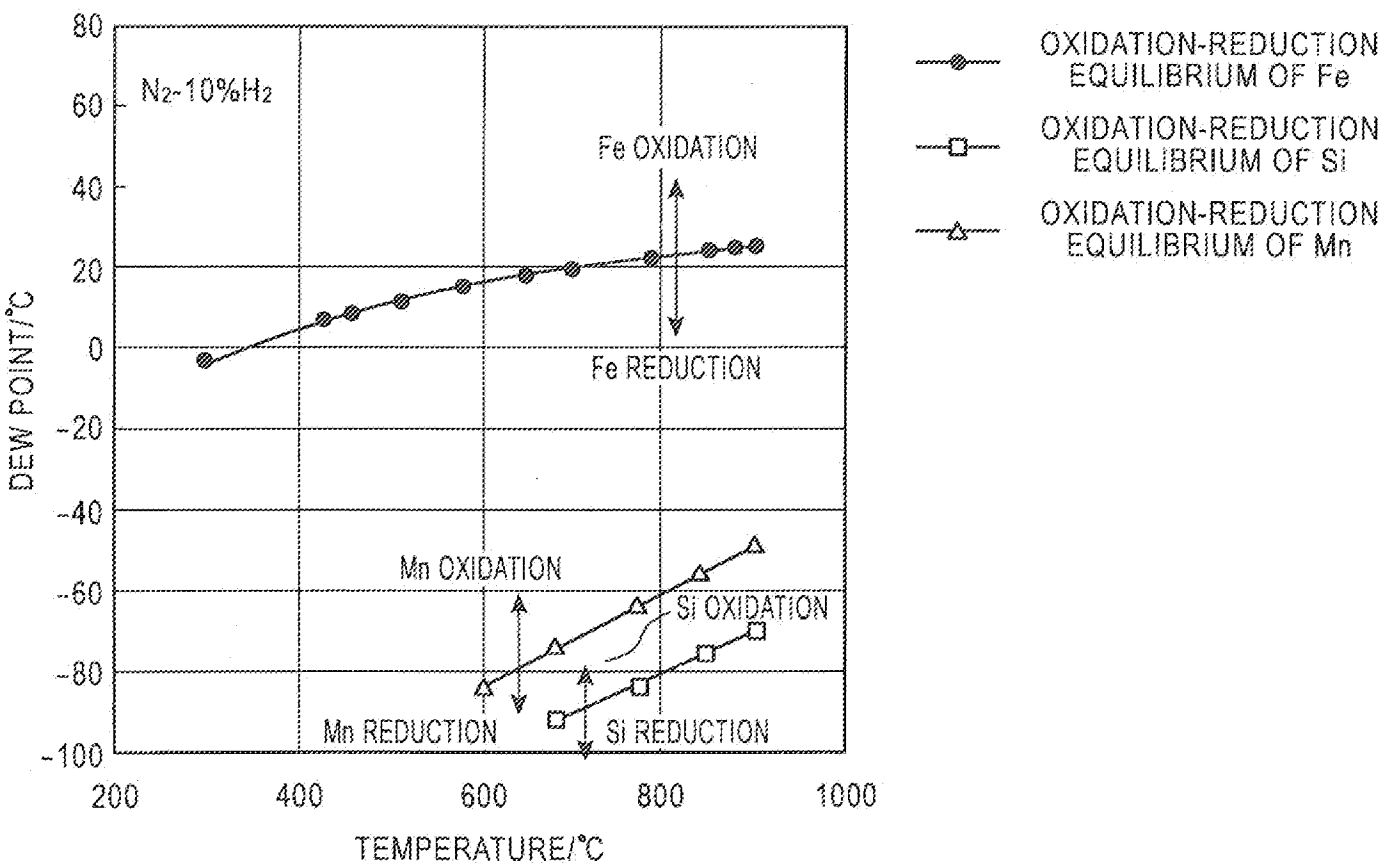
OXIDATION-REDUCTION EQUILIBRIUM OF Fe
OXIDATION-REDUCTION EQUILIBRIUM OF Si
OXIDATION-REDUCTION EQUILIBRIUM OF Mn
N2-10%H2
Fe OXIDATION
Fe REDUCTION
Mn OXIDATION
Si OXIDATION
Mn REDUCTION
Si REDUCTION
DEW POINT/°C
80
60
40
20
0
-20
-40
-60
-80
-100
200
400
600
800
1000
TEMPERATURE/°C

HIGH-STRENGTH HOT-DIP GALVANIZED STEEL SHEET AND METHOD FOR PRODUCING SAME

RELATED APPLICATIONS

This is a §371 of International Application No. PCT/JP2010/056287, with an international filing date of Mar. 31, 2010 (WO 2010/114174 A1, published Oct. 7, 2010), which is based on Japanese Patent Application Nos. 2009-085199, filed Mar. 31, 2009, and 2010-026066, filed Feb. 9, 2010, the subject matter of which is incorporated by reference.

TECHNICAL FIELD

This disclosure relates to a high-strength hot-dip galvanized steel sheet including, as a base material, a high-strength steel sheet containing Si and Mn and having excellent workability, and a method for producing the same.

BACKGROUND

In recent years, surface-treated steel sheets produced by imparting rust-preventive properties to base material steel sheets, in particular, hot-dip galvanized steel sheets and hot-dip galvannealed steel sheets, have been widely used in the fields of automobiles, household appliances, building materials, and the like. Furthermore, from the standpoint of improvement in fuel consumption of automobiles and in crashworthiness of automobiles, there has been an increased demand to decrease thickness by strengthening the materials for automobile bodies and to decrease the weight of and increase the strength of automobile bodies. For that purpose, application of high-strength steel sheets to automobiles has been promoted.

In general, a hot-dip galvanized steel sheet is produced by a method in which a thin steel sheet obtained by hot rolling or cold rolling a slab is used as a base material, and the base material steel sheet is subjected to recrystallization annealing and a hot-dip galvanizing treatment in an annealing furnace in a continuous hot-dip galvanizing line (hereinafter, referred to as "CGL"). When a hot-dip galvannealed steel sheet is produced, after the hot-dip galvanizing treatment, a galvannealing treatment is further carried out.

Examples of the heating furnace type of an annealing furnace in a CGL include a DFF type (direct fired furnace type), a NOF type (non-oxidizing furnace type), and an all radiant tube type. In recent years, CGLs equipped with all radiant tube type heating furnaces have been increasingly constructed because of ease of operation, less likely occurrence of pickup, and the like, which makes it possible to produce high-quality coated steel sheets at low cost. However, unlike the DFF type (direct fired furnace type) or the NOF type (non-oxidizing furnace type), since an oxidizing step is not performed immediately before annealing in the all radiant tube type heating furnace, the all radiant tube type heating furnace is disadvantageous in terms of securing coatability regarding steel sheets containing easily oxidizable elements, such as Si and Mn.

As the method for producing a hot-dip coated steel sheet including, as a base material, a high-strength steel sheet containing large amounts of Si and Mn, Japanese Unexamined Patent Application Publication No. 2004-323970 and Japanese Unexamined Patent Application Publication No. 2004-315960 each disclose a technique in which, by increasing the dew point by specifying the heating temperature in a reducing furnace using a relational expression with a water vapor partial pressure, the surface layer of the base material is internally oxidized. However, since the area where the dew point is controlled is assumed to be the entire inside of the furnace, it is difficult to control the dew point, and stable operation is difficult. Furthermore, when a hot-dip galvannealed steel sheet is produced with unstable control of dew point, there is a variation in the distribution of internal oxides formed in the substrate steel sheet, and there is a concern that defects, such as uneven wettability of coating and uneven galvannealing, may occur in the longitudinal direction and in the width direction of the steel sheet.

Furthermore, Japanese Unexamined Patent Application Publication No. 2006-233333 discloses a technique in which by specifying not only $H_2O$ and $O_2$, which are oxidizing gases, but also the $CO_2$ concentration at the same time, the surface layer of the base material immediately before coating is internally oxidized, and external oxidation is suppressed, thereby improving coating appearance. However, in JP '333, as in JP '970 and JP '960, because of the presence of internal oxides, fractures easily occur during working, and resistance to peeling of coating is degraded. Degradation in corrosion resistance is also observed. Regarding $CO_2$, there is a concern that contamination may occur in the furnace or carburization may occur in the surface of the steel sheet, resulting in a change in mechanical properties.

Furthermore, recently, high-strength hot-dip galvanized steel sheets and high-strength hot-dip galvannealed steel sheets have been increasingly applied to spots that are difficult to work, and resistance to peeling of coating during high-level work has been regarded as important. Specifically, when a coated steel sheet is subjected to bending work with a bending angle exceeding 90° to be bent at an acute angle or a steel sheet is subjected to working because of an applied impact, it is required to suppress peeling of coating at the working spot.

To satisfy such properties, it is not only required to ensure a desired texture of a steel sheet by adding a large amount of Si to the steel, but it is also required to more highly control the texture and structure of a surface layer of a substrate steel sheet directly below the coating layer, from which fractures and the like during high-level work may originate. However, such control is difficult with conventional techniques. It has not been possible to produce a hot-dip galvanized steel sheet having excellent resistance to peeling of coating during high-level work, using a Si-containing high-strength steel sheet as a base material in a CGL equipped with an all radiant tube type heating furnace as an annealing furnace.

It could therefore be helpful to provide a high-strength hot-dip galvanized steel sheet including, as a base material, a steel sheet containing Si and Mn and having excellent coating appearance, corrosion resistance, and resistance to peeling of coating during high-level work; and a method for producing the same.

SUMMARY

We provide a method for producing a high-strength hot-dip galvanized steel sheet including a steel sheet containing, in percent by mass, 0.01% to 0.18% of C, 0.02% to 2.0% of Si, 1.0% to 3.0% of Mn, 0.001% to 1.0% of Al, 0.005% to 0.060% of P, 0.01% or less of S, and the balance being Fe and incidental impurities, and a galvanized coating layer on each surface of the steel sheet with a coating weight of 20 to 120 $g/m^2$ per surface, the method including, when the steel sheet is subjected to annealing and a hot-dip galvanizing treatment in a continuous hot-dip galvanizing line, the dew point of the atmosphere is controlled to −40° C. or lower in the annealing furnace temperature range of 750° C. or higher.

We also provide a high-strength hot-dip galvanized steel sheet produced by the method, and the amount of at least one oxide selected from oxides of Fe, Si, Mn, Al, P, B, Nb, Ti, Cr, Mo, Cu, and Ni, formed in the surface layer portion of the steel sheet, within 100 μm from the surface of the substrate steel sheet, directly below the galvanized coating layer, is 0.060 g/m$^2$ or less per surface.

BRIEF DESCRIPTION OF THE DRAWING

FIG. 1 is a graph showing the relationship between the dew point and the oxidation-reduction equilibria of Si and Mn.

DETAILED DESCRIPTION

Conventionally, regarding steel sheets containing easily oxidizable elements, such as Si and Mn, the steel sheets are internally oxidized actively to improve coatability. However, at the same time, corrosion resistance and workability degrade. Accordingly, we have conducted studies on a method of solving the problems using an unconventional new approach. As a result, it has been found that, by appropriately controlling the atmosphere in the annealing step, formation of internal oxides is suppressed in the surface layer portion of the steel sheet directly below the coating layer, and it is possible to obtain excellent coating appearance, higher corrosion resistance, and good resistance to peeling of coating during high-level work. Specifically, annealing and a hot-dip galvanizing treatment are performed while controlling the dew point of the atmosphere to −40° C. or lower in the annealing furnace temperature range of 750° C. or higher. By controlling the dew point of the atmosphere to −40° C. or lower in the annealing furnace temperature range of 750° C. or higher, the oxygen potential at the interface between the steel sheet and the atmosphere is decreased, and it is possible to suppress selective surface diffusion and oxidation (hereinafter, referred to as surface segregation) of Si, Mn, and the like without forming internal oxides.

The 7th International Conference on Zinc and Zinc Alloy Coated Steel Sheet, Galvatech 2007, Proceedings p404 shows that, when oxygen potentials are converted to dew points on the basis of thermodynamic data of oxidation reactions of Si and Mn, it is not possible to prevent oxidation at 800° C. in the presence of $N_2$-5% $H_2$ unless the dew point is lower than −80° C. for Si and the dew point is lower than −60° C. for Mn. Consequently, in the case where a high-strength steel sheet containing Si and Mn is annealed, it has been considered that, even if the hydrogen concentration is increased, surface segregation cannot be prevented unless the dew point is set to be at least lower than −80° C. Therefore, it has not been attempted conventionally to perform galvanization after performing annealing at a dew point of −40° C. to −70° C.

FIG. 1 is a graph showing the relationship between the dew point and the oxidation-reduction equilibria of Si and Mn, which are calculated as described below on the basis of thermodynamic data of oxidation reactions of Si and Mn shown in Kinzoku Butsuri Kagaku (Physical Chemistry of Metal), pp. 72-73, published on May 20, 1996, The Japan Institute of Metals.

The oxidation-reduction equilibrium of Si in a hydrogen-nitrogen atmosphere can be expressed by the following formula:

$$SiO_2\ (\text{solid})+2H_2\ (\text{gas})=Si+2H_2O\ (\text{gas}) \quad (1).$$

Assuming the activity of Si is 1, the equilibrium constant K for this reaction can be written as:

$$K=(\text{square of } H_2O \text{ partial pressure})/(\text{square of } H_2 \text{ partial pressure}) \quad (2).$$

The standard free energy ΔG(1) is given by, $$\Delta G(1)=-RT\ln K \quad (3)$$

where R is the gas constant, and T is the temperature.

The standard free energy ΔG(4) and the standard free energy ΔG(5) for the reaction formulae:

$$H_2\ (\text{gas})+\tfrac{1}{2}O_2\ (\text{gas})=H_2O\ (\text{gas}) \quad (4), \text{ and}$$

$$Si\ (\text{solid})+O_2\ (\text{gas})=SiO_2\ (\text{solid}) \quad (5)$$

are given, as a function of T, by, $$\Delta G(4)=-246000+54.8T, \text{ and}$$

$$\Delta G(5)=-902100+174T.$$

Consequently, from 2×(4)-(5), $$\Delta G(1)=410100-64.4T \quad (6)$$

is obtained.

From (3)=(6), $$K=\exp\{(1/R)(64.4-410100/T)\} \quad (7)$$

is obtained.

Furthermore, from (2)=(7) and $H_2$ partial pressure=0.1 atm (in the case of 10%), the $H_2O$ partial pressure at each temperature T can be calculated, and by converting this to a dew point, FIG. 1 can be obtained.

Regarding Mn, similarly, the oxidation-reduction equilibrium of Mn in a hydrogen-nitrogen atmosphere can be expressed by the following formula:

$$MnO\ (\text{solid})+H_2\ (\text{gas})=Mn+H_2O\ (\text{gas}) \quad (8).$$

The equilibrium constant K for this reaction can be written as:

$$K=(\text{square of } H_2O \text{ partial pressure})/(\text{square of } H_2 \text{ partial pressure}) \quad (9).$$

The standard free energy ΔG(8) is given by, $$\Delta G(8)=-RT\ln K \quad (10)$$

where R is the gas constant, and T is the temperature.

The standard free energy ΔG(11) and the standard free energy ΔG(12) for the reaction formulae:

$$H_2\ (\text{gas})+\tfrac{1}{2}O_2\ (\text{gas})=H_2O\ (\text{gas}) \quad (11), \text{ and}$$

$$Mn\ (\text{solid})+\tfrac{1}{2}O_2\ (\text{gas})=MnO\ (\text{solid}) \quad (12)$$

are given, as a function of T, by, $$\Delta G(11)=-246000+54.8T, \text{ and}$$

$$\Delta G(12)=-384700+72.8T.$$

Consequently, from (11)-(12), $$\Delta G(8)=138700-18.0T \quad (13)$$

is obtained.

From (10)=(13), $$K=\exp\{(1/R)(18.0-138700/T)\} \quad (14)$$

is obtained.

Furthermore, from (9)=(14) and $H_2$ partial pressure=0.1 atm (in the case of 10%), the $H_2O$ partial pressure at each temperature T can be calculated, and by converting this to a dew point, FIG. 1 can be obtained.

As is evident from FIG. 1, at 800° C., which is the standard annealing temperature, Si is in an oxidized state at a dew point of −80° C. or higher, and to change the Si state to a reduced state, it is necessary to set the dew point to be lower than −80° C. Regarding Mn, similarly, the reduced state is not achieved unless the dew point is lower than −60° C. This result is in agreement with the result in The 7th International Conference on Zinc and Zinc Alloy Coated Steel Sheet Proceedings.

Furthermore, it is necessary to heat from room temperature to 800° C. or higher during annealing. The results shown in FIG. 1 and The 7th International Conference on Zinc and Zinc Alloy Coated Steel Sheet Proceedings show that as the temperature decreases, the dew points that bring about the reduced states of Si and Mn decrease, and suggest that from room temperature to 800° C., an extremely low dew point lower than −100° C. is required. The results strongly suggest that it will be industrially impossible to achieve an annealing environment in which heating is performed to the annealing temperature while preventing the oxidation of Si and Mn.

What has been described above is technical common knowledge that can be easily derived from thermodynamic data known to persons of ordinary skill in the art, and also technical knowledge that hinders the attempt to perform annealing at a dew point of −40° C. to −70° C. at which Si and Mn are supposed to be selectively oxidized.

However, we considered that, even at a dew point of −40° C. to −70° C. at which surface segregation of Si and Mn are originally believed to occur, in spite of the dew point range in which oxidation takes place in terms of equilibrium theory, there may be a possibility that, in the case of a short-time heat treatment, such as continuous annealing, kinetically, surface segregation does not proceed to such an extent as to largely impair coatability.

We thus discovered that, when a steel sheet is subjected to annealing and a hot-dip galvanizing treatment in a continuous hot-dip galvanizing line, the dew point of the atmosphere is controlled to −40° C. or lower in the annealing furnace temperature range of 750° C. or higher.

Usually, since the dew point of the annealing atmosphere for steel sheets is −30° C. or higher, the moisture in the annealing atmosphere must be removed to control the dew point to −40° C. or lower, and to control the dew point of the atmosphere of the entire annealing furnace to −40° C., huge equipment and operating costs are required. However, we discovered that, since the dew point is controlled to −40° C. or lower only in a limited region where the annealing furnace temperature is 750° C. or higher, equipment and operating costs can be reduced. Moreover, by controlling only the limited region of 750° C. or higher, predetermined properties can be satisfactorily obtained.

Furthermore, by performing annealing and a hot-dip galvanizing treatment while controlling the dew point of the atmosphere to −40° C. or lower in the temperature range of 600° C. or higher, more satisfactory coating peeling performance can be obtained. By controlling the dew point of the atmosphere to −45° C. or lower in the temperature range of 750° C. or higher or 600° C. or higher, much more satisfactory coating peeling performance can be obtained.

In such a manner, by controlling the dew point of the atmosphere only in the limited region, internal oxides are not formed, surface segregation is suppressed to the utmost, and thus it is possible to obtain a high-strength hot-dip galvanized steel sheet which is free from bare spots and which has excellent coating appearance, corrosion resistance, and resistance to peeling of coating during high-level work. Note that the expression "having excellent coating appearance" means having an appearance which includes no bare spots or uneven galvannealing.

Regarding the high-strength hot-dip galvanized steel sheet obtained by the method described above, in the surface layer portion of the steel sheet, within 100 μm from the surface of the substrate steel sheet, directly below the galvanized coating layer, formation of oxides of at least one selected from Fe, Si, Mn, Al, P, and optionally, B, Nb, Ti, Cr, Mo, Cu, and Ni (excluding Fe only) is suppressed, and the total amount of formation is suppressed to 0.060 g/m$^2$ or less per surface. This leads to excellent coating appearance and marked improvement in corrosion resistance, achieves prevention of fractures during bending work at the surface layer of the substrate steel sheet, and results in excellent resistance to peeling of coating during high-level work.

We thus provide:

[1] A method for producing a high-strength hot-dip galvanized steel sheet including a steel sheet containing, in percent by mass, 0.01% to 0.18% of C, 0.02% to 2.0% of Si, 1.0% to 3.0% of Mn, 0.001% to 1.0% of Al, 0.005% to 0.060% of P, 0.01% or less of S, and the balance being Fe and incidental impurities, and a galvanized coating layer on each surface of the steel sheet with a coating weight of 20 to 120 g/m$^2$ per surface, the method being characterized in that, when the steel sheet is subjected to annealing and a hot-dip galvanizing treatment in a continuous hot-dip galvanizing line, the dew point of the atmosphere is controlled to −40° C. or lower in the annealing furnace temperature range of 750° C. or higher.

[2] The method for producing a high-strength hot-dip galvanized steel sheet according to the above [1], characterized in that the steel sheet further contains, as a component, in percent by mass, at least one element selected from 0.001% to 0.005% of B, 0.005% to 0.05% of Nb, 0.005% to 0.05% of Ti, 0.001% to 1.0% of Cr, 0.05% to 1.0% of Mo, 0.05% to 1.0% of Cu, and 0.05% to 1.0% of Ni.

[3] The method for producing a high-strength hot-dip galvanized steel sheet according to the above [1] or [2], characterized in that after the hot-dip galvanizing treatment, the steel sheet is subjected to a galvannealing treatment by heating to a temperature of 450° C. to 600° C. so that the Fe content in the galvanized coating layer is in the range of 7% to 15% by mass.

[4] A high-strength hot-dip galvanized steel sheet characterized in that it is produced by the production method according to any one of the above [1] to [3], and the amount of at least one oxide selected from oxides of Fe, Si, Mn, Al, P, B, Nb, Ti, Cr, Mo, Cu, and Ni, formed in the surface layer portion of the steel sheet, within 100 μm from the surface of the substrate steel sheet, directly below the galvanized coating layer, is 0.060 g/m$^2$ or less per surface.

"High strength" corresponds to a tensile strength TS of 340 MPa or more. Furthermore, the high-strength hot-dip galvanized steel sheet includes both a coated steel sheet which is not subjected to a galvannealing treatment after the hot-dip galvanizing treatment (hereinafter, may be referred to as "GI") and a coated steel sheet which is subjected to a galvannealing treatment after the hot-dip galvanizing treatment (hereinafter, may be referred to as "GA").

It is thus possible to obtain a high-strength hot-dip galvanized steel sheet having excellent coating appearance, corrosion resistance, and resistance to peeling of coating during high-level work.

Our steel sheets and methods will be specifically described below. In the description below, the unit of the content of each element in the steel composition and unit of the content of each element in the coating layer composition are each "percent by mass" and, hereinafter, units are simply represented by "%" unless otherwise stated.

First, the annealing atmospheric condition that determines the structure of the surface of the substrate steel sheet directly below the coating layer, which is the most important requirement, will be described.

In the high-strength hot-dip galvanized steel sheet in which large amounts of Si and Mn are incorporated into the steel to exhibit satisfactory corrosion resistance and resistance to peeling of coating during high-level work, it is required to minimize internal oxidation of the surface layer of the substrate steel sheet directly below the coating layer, from which corrosion, fractures during high-level work, and the like may originate.

On the other hand, it is possible to improve coatability by promoting internal oxidation of Si and Mn, but this degrades corrosion resistance and workability. Therefore, it is necessary to improve corrosion resistance and workability by suppressing internal oxidation while maintaining good coatability by a method other than the method of promoting internal oxidation of Si and Mn.

As a result, to ensure coatability, by decreasing the oxygen potential in the annealing step, the activities of Si, Mn, and the like, which are easily oxidizable elements, are decreased in the surface layer portion of the substrate steel sheet. The external oxidation of these elements is suppressed, resulting in improvement in coatability. The internal oxidation in the surface layer portion of the substrate steel sheet is also suppressed, resulting in improvement in corrosion resistance and high workability.

When annealing and a hot-dip galvanizing treatment are performed in a continuous hot-dip galvanizing line, by controlling the dew point of the atmosphere to −40° C. or lower in the annealing furnace temperature range of 750° C. or higher, such advantageous effects can be obtained. By controlling the dew point of the atmosphere to −40° C. or lower in the annealing furnace temperature range of 750° C. or higher, the oxygen potential at the interface between the steel sheet and the atmosphere is decreased, and it is possible to suppress selective surface diffusion and surface segregation of Si, Mn, and the like without forming internal oxides. This can eliminate bare spots and achieve higher corrosion resistance and good resistance to peeling of coating during high-level work.

The reason for setting the temperature range in which the dew point is controlled is set to 750° C. or higher is as follows. In the temperature range of 750° C. or higher, surface segregation and internal oxidation easily occur to such an extent that causes problems of occurrence of bare spots, degradation in corrosion resistance, degradation in resistance to peeling of coating, and the like. Therefore, the temperature range is set to 750° C. or higher in which the advantageous effects are exhibited. Furthermore, by setting the temperature range in which the dew point is controlled is set to 600° C. or higher, surface segregation and internal oxidation can be more stably suppressed.

The upper limit of the temperature range in which the dew point is controlled to −40° C. or lower is not particularly set. However, the temperature range exceeding 900° C. is disadvantageous in view of the increase in cost, although the advantageous effects are not affected. Therefore, preferably, the upper limit of the temperature range is 900° C. or lower.

The reason for setting the dew point at −40° C. or lower is as follows. The effect of suppressing surface segregation starts to be observed at a dew point of −40° C. or lower. Although the lower limit of the dew point is not particularly set, at lower than −70° C., the effect is saturated, which is disadvantageous in terms of cost. Therefore, preferably, the dew point is −70° C. or higher.

The components of the high-strength hot-dip galvanized steel sheet will now be described.

C: 0.01% to 0.18%

C improves workability by forming the martensitic steel structure and the like. For that purpose, the C content is required to be 0.01% or more. On the other hand, when the C content exceeds 0.18%, weldability degrades. Therefore, the C content is set in the range of 0.01% to 0.18%.

Si: 0.02% to 2.0%

Si is an effective element for strengthening steel to obtain good quality, and to obtain the intended strength the Si content is required to be 0.02% or more. When the Si content is less than 0.02%, it is not possible to obtain the strength in the range to which our steel sheets and methods are applied, and no particular problems are found in resistance to peeling of coating during high-level work. On the other hand, when the Si content exceeds 2.0%, it is difficult to improve resistance to peeling of coating during high-level work. Therefore, the Si content is set in the range of 0.02% to 2.0%. As the Si content increases, TS increases and elongation tends to decrease. Consequently, it is possible to change the Si content depending on the required properties. In particular, 0.4 or more is suitable for a high-strength material.

Mn: 1.0% to 3.0%

Mn is an effective element for increasing the strength of steel. To ensure mechanical properties and strength, the Mn content is required to be 1.0% or more. On the other hand, when the Mn content exceeds 3.0%, it is difficult to secure weldability and coating adhesion and to secure the balance between strength and ductility. Therefore, the Mn content is set in the range of 1.0% to 3.0%.

Al: 0.001% to 1.0%

Al is added for the purpose of deoxidation of molten steel. However, when the Al content is less than 0.001%, the purpose is not attained. The molten steel deoxidizing effect is obtained at the Al content of 0.001% or more. On the other hand, the Al content exceeding 1.0% results in an increase in cost. Therefore, the Al content is set in the range of 0.001% to 1.0%.

P: 0.005% to 0.060%

P is one of the unavoidably contained elements. When the P content is set to less than 0.005%, the increase in cost is of concern. Therefore, the P content is set at 0.005% or more. On the other hand, when the P content exceeds 0.060%, weldability degrades. Moreover, surface quality degrades. Furthermore, in the case where no galvannealing treatment is involved, coating adhesion degrades. In the case where a galvannealing treatment is performed, a desired degree of galvannealing cannot be achieved unless the galvannealing temperature is increased. Furthermore, when the galvannealing temperature is increased to achieve a desired degree of galvannealing, ductility degrades and galvannealed coating adhesion degrades. Consequently, it is not possible to obtain a desired degree of galvannealing, good ductility, and galvannealed coating at the same time. Therefore, the P content is set in the range of 0.005% to 0.060%.

S≤0.01%

S is one of the unavoidably contained elements. Although the lower limit is specified, when a large amount of S is contained, weldability degrades. Therefore, the S content is set to be 0.01% or less.

Furthermore, to control the balance between strength and ductility, as necessary, at least one element selected from 0.001% to 0.005% of B, 0.005% to 0.05% of Nb, 0.005% to 0.05% of Ti, 0.001% to 1.0% of Cr, 0.05% to 1.0% of Mo, 0.05% to 1.0% of Cu, and 0.05% to 1.0% of Ni may be added to the steel sheet. When added, the reasons for limiting the addition amounts of these elements to appropriate ranges are as follows.

B: 0.001% to 0.005%

When the B content is less than 0.001%, the hardening-accelerating effect is not easily obtained. On the other hand, when the B content exceeds 0.005%, coating adhesion degrades. Therefore, when contained, the B content is set in the range of 0.001% to 0.005%.

Nb: 0.005% to 0.05%

When the Nb content is less than 0.005%, the strength adjusting effect and the coating adhesion improving effect when added in combination with Mo are not easily obtained. On the other hand, the Nb content exceeding 0.05% leads to an increase in cost. Therefore, when contained, the Nb content is set in the range of 0.005% to 0.05%.

Ti: 0.005% to 0.05%

When the Ti content is less than 0.005%, the strength adjusting effect is not easily obtained. On the other hand, the Ti content exceeding 0.05% leads to degradation in coating adhesion. Therefore, when contained, the Ti content is set in the range of 0.005% to 0.05%.

Cr: 0.001% to 1.0%

When the Cr content is less than 0.001%, the hardenability effect is not easily obtained. On the other hand, when the Cr content exceeds 1.0%, Cr surface segregates, resulting in degradation in coating adhesion and weldability. Therefore, when contained, the Cr content is set in the range of 0.001% to 1.0%.

Mo: 0.05% to 1.0%

When the Mo content is less than 0.05%, the strength adjusting effect and the coating adhesion improving effect when added in combination with Nb or Ni and Cu are not easily obtained. On the other hand, the Mo content exceeding 1.0% leads to an increase in cost. Therefore, when contained, the Mo content is set in the range of 0.05% to 1.0%.

Cu: 0.05% to 1.0%

When the Cu content is less than 0.05%, the accelerating effect of formation of retained γ phase and the coating adhesion improving effect when added in combination with Ni or Mo are not easily obtained. On the other hand, the Cu content exceeding 1.0% leads to an increase in cost. Therefore, when contained, the Cu content is set in the range of 0.05% to 1.0%.

Ni: 0.05% to 1.0%

When the Ni content is less than 0.05%, the accelerating effect of formation of retained γ phase and the coating adhesion improving effect when added in combination with Cu and Mo are not easily obtained. On the other hand, the Ni content exceeding 1.0% leads to an increase in cost. Therefore, when contained, the Ni content is set in the range of 0.05% to 1.0%.

The balance other than those described above is Fe and incidental impurities.

Next, the method for producing the high-strength hot-dip galvanized steel sheet and reasons for limitations thereof will be described.

The steel having the chemical composition described above is hot-rolled and then cold-rolled to form a steel sheet. Subsequently, the steel sheet is subjected to annealing and a hot-dip galvanizing treatment in a continuous hot-dip galvanizing line. In this process, the dew point of the atmosphere is controlled to −40° C. or lower in the annealing furnace temperature range of 750° C. or higher. This is the most important requirement. Furthermore, when the temperature range in which the dew point is controlled is set to 600° C. or higher, the surface segregation and internal oxidation can be more stably suppressed.

Hot Rolling

Hot rolling can be performed under the conditions usually employed.

Pickling

After the hot rolling, a pickling treatment is preferably carried out. Scales formed on the surface are removed in the pickling step, and then cold rolling is performed. The pickling conditions are not particularly limited.

Cold Rolling

Cold rolling is performed preferably at a reduction ratio of 40% to 80%. When the reduction ratio is less than 40%, the recrystallization temperature is lowered and, thus, mechanical properties are easily degraded. On the other hand, when the reduction ratio exceeds 80%, the rolling cost increases because the high-strength steel sheet is treated, and also coating properties are degraded because the amount of surface segregation increases during annealing.

The cold-rolled steel sheet is subjected to annealing, and then to a hot-dip galvanizing treatment.

In the annealing furnace, a heating step is performed in the heating section in the upstream in which the steel sheet is heated to a predetermined temperature, and a soaking step is performed in the soaking section in the downstream in which the steel sheet is held at the predetermined temperature for a predetermined period of time. Then, as described above, annealing and a hot-dip galvanizing treatment are performed with the dew point of the atmosphere being controlled to −40° C. or lower in the annealing furnace temperature range of 750° C. or higher.

The gas composition in the annealing furnace includes nitrogen, hydrogen, and unavoidable impurities. Other gas components may be included as long as the advantageous effects are not impaired. When the hydrogen concentration is less than 1 vol %, the activation effect by reduction cannot be obtained, and the resistance to peeling of coating degrades. Although the upper limit is not particularly specified, when the hydrogen concentration exceeds 50 vol %, the cost increases and the effect is saturated. Therefore, the hydrogen concentration is preferably 1 vol % to 50 vol %, and more preferably 5 vol % to 30 vol %.

The hot-dip galvanizing treatment can be performed by a common method.

Next, as necessary, a galvannealing treatment is performed.

In the case where a galvannealing treatment is performed subsequent to the hot-dip galvanizing treatment, after the hot-dip galvanizing treatment, preferably, the galvannealing treatment is performed by heating the steel sheet at 450° C. to 600° C. such that the Fe content in the coating layer is in the range of 7% to 15%. When the Fe content is less than 7%, uneven galvannealing may occur or flaking properties may degrade. On the other hand, when the Fe content exceeds 15%, resistance to peeling of coating degrades.

By the method described above, a high-strength hot-dip galvanized steel sheet is obtained. The high-strength hot-dip galvanized steel sheet has a galvanized coating layer on each surface of the steel sheet with a coating weight of 20 to 120 $g/m^2$ per surface. When the coating weight is less than 20 g/m$^2$, it is difficult to ensure corrosion resistance. On the other hand, when the coating weight exceeds 120 g/m$^2$, resistance to peeling of coating degrades.

The structure of the surface of the substrate steel sheet directly below the coating layer has the following characteristics. In the surface layer portion of the steel sheet, within 100 μm from the surface of the substrate steel sheet, directly below the galvanized coating layer, the amount of at least one oxide selected from oxides of Fe, Si, Mn, Al, and P, and additionally, B, Nb, Ti, Cr, Mo, Cu, and Ni, in total, is suppressed to 0.060 g/m$^2$ or less per surface.

In the hot-dip galvanized steel sheet in which Si and a large amount of Mn are incorporated into the steel to exhibit satisfactory corrosion resistance and resistance to peeling of coating during high-level work, it is required to minimize internal oxidation of the surface layer of the substrate steel sheet directly below the coating layer, from which corrosion, fractures during high-level work, and the like may originate. Accordingly, first, to ensure coatability, by decreasing the oxygen potential in the annealing step, the activities of Si, Mn, and the like, which are easily oxidizable elements, are decreased in the surface layer portion of the base material. Thus, the external oxidation of these elements is suppressed, resulting in improvement in coatability. Furthermore, the internal oxidation formed in the surface layer portion of the base material is also suppressed, resulting in improvement in corrosion resistance and high workability. Such an effect is obtained by suppressing the amount of at least one oxide selected from oxides of Fe, Si, Mn, Al, and P, and additionally, B, Nb, Ti, Cr, Mo, Cu, and Ni, in total, to 0.060 g/m$^2$ or less in the surface layer portion of the steel sheet, within 100 μm from the surface of the substrate steel sheet. When the total amount of formation of oxides (hereinafter, referred to as the amount of internal oxidation) exceeds 0.060 g/m$^2$, corrosion resistance and high workability degrade. Furthermore, even if the amount of internal oxidation is suppressed to less than 0.0001 g/m$^2$, the effect of improving corrosion resistance and high workability is saturated. Therefore, the lower limit of the amount of internal oxidation is preferably 0.0001 g/m$^2$ or more.

In addition to what has been described above, to improve resistance to peeling of coating, the matrix of the base material in which Si/Mn-based oxides grow is preferably composed of a ferrite phase which is soft and highly workable.

EXAMPLE 1

Our steel sheets and methods will now be specifically described on the basis of Examples.

Hot-rolled steel sheets having steel compositions shown in Table 1 were each subjected to pickling to remove scales, and then subjected to cold rolling under the conditions shown in Table 2 to obtain cold-rolled steel sheets with a thickness of 1.0 mm.

TABLE 1

(mass %)

| Steel type | C | Si | Mn | Al | P | S | Cr | Mo | B | Nb | Cu | Ni | Ti |
|---|---|---|---|---|---|---|---|---|---|---|---|---|---|
| A | 0.05 | 0.03 | 2.0 | 0.03 | 0.01 | 0.004 | — | — | — | — | — | — | — |
| AA | 0.12 | 0.8 | 1.9 | 0.03 | 0.01 | 0.004 | — | — | — | — | — | — | — |
| AB | 0.02 | 0.4 | 1.9 | 0.04 | 0.01 | 0.003 | — | — | — | — | — | — | — |
| AC | 0.17 | 1.2 | 1.9 | 0.03 | 0.01 | 0.004 | — | — | — | — | — | — | — |
| AD | 0.10 | 1.6 | 2.0 | 0.04 | 0.01 | 0.003 | — | — | — | — | — | — | — |
| AE | 0.05 | 2.0 | 2.1 | 0.04 | 0.01 | 0.003 | — | — | — | — | — | — | — |
| AF | 0.12 | 0.8 | 2.9 | 0.04 | 0.01 | 0.004 | — | — | — | — | — | — | — |
| AG | 0.12 | 0.8 | 1.9 | 0.9 | 0.01 | 0.004 | — | — | — | — | — | — | — |
| H | 0.05 | 0.1 | 2.1 | 0.03 | 0.05 | 0.004 | — | — | — | — | — | — | — |
| AH | 0.12 | 0.8 | 2.1 | 0.04 | 0.05 | 0.003 | — | — | — | — | — | — | — |
| AI | 0.12 | 0.8 | 2.1 | 0.03 | 0.01 | 0.009 | — | — | — | — | — | — | — |
| AJ | 0.12 | 0.8 | 2.1 | 0.02 | 0.01 | 0.003 | 0.6 | — | — | — | — | — | — |
| AK | 0.12 | 0.8 | 1.9 | 0.04 | 0.01 | 0.004 | — | 0.1 | — | — | — | — | — |
| AL | 0.12 | 0.8 | 2.2 | 0.03 | 0.01 | 0.004 | — | — | 0.004 | — | — | — | — |
| M | 0.05 | 0.1 | 2.0 | 0.05 | 0.01 | 0.004 | — | — | 0.002 | 0.02 | — | — | — |
| AM | 0.12 | 0.8 | 2.0 | 0.05 | 0.01 | 0.004 | — | — | 0.001 | 0.03 | — | — | — |
| AN | 0.12 | 0.8 | 2.1 | 0.03 | 0.01 | 0.003 | — | 0.1 | — | — | 0.1 | 0.2 | — |
| AO | 0.12 | 0.8 | 2.1 | 0.04 | 0.01 | 0.003 | — | — | 0.002 | — | — | — | 0.02 |
| AP | 0.12 | 0.8 | 1.9 | 0.03 | 0.01 | 0.003 | — | — | — | — | — | — | 0.04 |
| AQ | 0.20 | 0.8 | 2.2 | 0.04 | 0.01 | 0.003 | — | — | — | — | — | — | — |
| AR | 0.12 | 2.1 | 2.0 | 0.04 | 0.01 | 0.004 | — | — | — | — | — | — | — |
| AS | 0.12 | 0.8 | 3.1 | 0.04 | 0.01 | 0.004 | — | — | — | — | — | — | — |
| AT | 0.12 | 0.8 | 2.1 | 1.1 | 0.01 | 0.003 | — | — | — | — | — | — | — |
| AU | 0.12 | 0.8 | 2.1 | 0.03 | 0.07 | 0.003 | — | — | — | — | — | — | — |
| AV | 0.12 | 0.8 | 2.1 | 0.04 | 0.01 | 0.02 | — | — | — | — | — | — | — |

Each of the resulting cold-rolled steel sheets was fed into a CGL equipped with an all radiant tube type heating furnace as an annealing furnace. In the CGL, as shown in Table 2, annealing was performed by passing the steel sheet through the annealing furnace while controlling the dew point in the annealing furnace temperature range of 750° C. or higher as shown in Table 2, and then a hot-dip galvanizing treatment was performed in an Al-containing Zn bath at 460° C.

The gas composition in the atmosphere included nitrogen, hydrogen, and unavoidable impurities, and the dew point was controlled by removing by absorption the moisture in the atmosphere. The hydrogen concentration in the atmosphere was basically set at 10 vol %.

Furthermore, a 0.14% Al-containing Zn bath was used for GA, and a 0.18% Al-containing Zn bath was used for GI. The coating weight was adjusted by gas wiping. Regarding GA, a galvannealing treatment was performed.

Appearance (coating appearance), corrosion resistance, and resistance to peeling of coating during high-level work, and workability were investigated for the resulting hot-dip galvanized steel sheets (GA and GI). Furthermore, the amount of oxides (amount of internal oxidation) present in the surface layer portion of the substrate steel sheet, up to a depth of 100 μm, directly below the coating layer was measured. Measurement methods and evaluation criteria are described below.

Appearance

The appearance was evaluated to be good (indicated by symbol ○) when defects, such as bare spots and uneven galvannealing, were not present. The appearance was evaluated to be poor (indicated by symbol x) when defects were present.

Corrosion Resistance

A salt spray test according to JIS Z 2371 (2000) was carried out for 3 days on a hot-dip galvannealed steel sheet with a size of 70 mm×150 mm. The corrosion product was removed by washing for one minute using chromic acid (concentration 200 g/L, 80° C.), and the coating corrosion weight loss ($g/m^2$·day) per surface before and after the test was measured by a weight method and evaluated on the basis of the following criteria:

○ (good): less than 20 $g/m^2$·day x (poor): 20 $g/m^2$·day or more.

Resistance to Peeling of Coating

Regarding the resistance to peeling of coating during high-level work, in GA, it is required to suppress peeling of coating at the bent spot when the coated steel sheet is bent at an acute angle with a bending angle exceeding 90°.

In this example, a cellophane tape was pressed against a working spot bent with a bending angle of 120° to transfer the peeled off pieces to the cellophane tape, and the amount of the peeled off pieces on the cellophane tape was measured as a count of Zn by a fluorescent x-ray method. In this process, the mask diameter was 30 mm, the accelerating voltage of fluorescent x-ray was 50 kV, the accelerating current was 50 mA, and the measurement time was 20 seconds. The resistance to peeling of coating was evaluated from the count of Zn on the basis of the following criteria. ⊙ and ○ indicate levels at which no problem arises in the coating peeling performance during high-level work. Δ indicates a level at which practical use may be possible depending on the degree of working x and xx indicate levels unsuitable for ordinary use.

Fluorescent x-ray count of Zn: Rank 0 to less than 500: ⊙

500 to less than 1,000: ○

1,000 to less than 2,000: Δ

2,000 to less than 3,000: x 3,000 or more: xx

In GI, resistance to peeling of coating in an impact test is required. A ball impact test was carried out, in which the working spot was subjected to tape peeling, and the presence or absence of peeling of the coating layer was visually determined. The ball impact conditions were as follows: ball weight, 1,000 g; and free fall drop height, 100 cm.

○: No peeling of coating layer x: Peeling of coating layer

Workability

Regarding workability, a JIS No. 5 tensile test piece was taken from a sample in a direction perpendicular to the rolling direction, and by performing a tensile test in accordance with JIS Z 2241 at a constant cross head speed of 10 mm/min, tensile strength (TS/MPa) and elongation (El %) were measured.

In the case where TS was less than 650 MPa, TS×El≥22,000 was evaluated to be good, and TS×El<22,000 was evaluated to be poor. In the case where TS was 650 MPa to less than 900 MPa, TS×El≥20,000 was evaluated to be good, and TS×El<20,000 was evaluated to be poor. In the case where TS was 900 MPa or more, TS×El≥18,000 was evaluated to be good, and TS×El<18,000 was evaluated to be poor.

Amount of Internal Oxidation in the Region Directly below the Coating Layer up to a Depth of 100 μm The amount of internal oxidation was measured by an "impulse furnace fusion-infrared absorption method." It is necessary to subtract the amount of oxygen contained in the base material (i.e., the high-strength steel sheet before being subjected to annealing). Therefore, the surface portions at both sides of the high-strength steel sheet after continuous annealing were removed by a depth of 100 μm or more, and then the oxygen concentration in the steel was measured. The measured value was defined as the amount of oxygen contained in the base material (OH). The oxygen concentration in the steel was also measured for the high-strength steel sheet after continuous annealing over the entire thickness of the steel sheet, and the measured value was defined as the amount of oxygen after internal oxidation (OI). Using the amount of oxygen in the high-strength steel sheet after internal oxidation (OI) and the amount of oxygen contained in the base material (OH), a difference between OI and OH (=OI−OH) was calculated, and the resulting value was converted to a value per unit area of one surface (i.e., 1 $m^2$), which was defined as the amount of internal oxidation ($g/m^2$).

The results obtained as described above are shown in Table 2 together with the production conditions.

TABLE 2

| | Steel | | | Production method | | | | | | | |
|---|---|---|---|---|---|---|---|---|---|---|---|
| | | | | | Annealing furnace | | | | | | |
| No. | Type | Si mass % | Mn mass % | Cold rolling reduction ratio (%) | Dew point at 750° C. or higher (° C.) | Highest achieving temperature (° C.) | Galvannealing temperature (° C.) | Amount of internal oxidation ($g/m^2$) | Coating weight ($g/m^2$) | Coating type | Fe content in coating layer (mass %) |
| 1 | A | 0.03 | 2.0 | 50 | −45 | 850 | 500 | 0.009 | 50 | GA | 10 |
| 2 | AA | 0.8 | 1.9 | 50 | −30 | 850 | 500 | 0.090 | 50 | GA | 10 |
| 3 | AA | 0.8 | 1.9 | 50 | −34 | 850 | 500 | 0.071 | 50 | GA | 10 |
| 4 | AA | 0.8 | 1.9 | 50 | −38 | 850 | 500 | 0.063 | 50 | GA | 10 |
| 5 | AA | 0.8 | 1.9 | 50 | −40 | 850 | 500 | 0.055 | 50 | GA | 10 |
| 6 | AA | 0.8 | 1.9 | 50 | −45 | 850 | 500 | 0.021 | 50 | GA | 10 |
| 7 | AA | 0.8 | 1.9 | 50 | −60 | 850 | 500 | 0.009 | 50 | GA | 10 |
| 8 | AA | 0.8 | 1.9 | 50 | −45 | 780 | 500 | 0.011 | 50 | GA | 10 |
| 9 | AA | 0.8 | 1.9 | 50 | −45 | 800 | 500 | 0.013 | 50 | GA | 10 |
| 10 | AA | 0.8 | 1.9 | 50 | −45 | 830 | 500 | 0.015 | 50 | GA | 10 |
| 11 | AA | 0.8 | 1.9 | 50 | −45 | 890 | 500 | 0.019 | 50 | GA | 10 |

TABLE 2-continued

| | | | | | | | | | | | |
|---|---|---|---|---|---|---|---|---|---|---|---|
| 12 | AA | 0.8 | 1.9 | 50 | −45 | 850 | Not galvan-nealed | 0.018 | 50 | GI | 1 |
| 13 | AA | 0.8 | 1.9 | 50 | −35 | 850 | Not galvan-nealed | 0.074 | 50 | GI | 1 |
| 14 | AA | 0.8 | 1.9 | 50 | −45 | 800 | Not galvan-nealed | 0.020 | 50 | GI | 1 |
| 15 | AA | 0.8 | 1.9 | 50 | −60 | 850 | Not galvan-nealed | 0.013 | 50 | GI | 1 |
| 16 | AA | 0.8 | 1.9 | 50 | −45 | 850 | 460 | 0.021 | 50 | GA | 8 |
| 17 | AA | 0.8 | 1.9 | 50 | −45 | 850 | 550 | 0.020 | 50 | GA | 13 |
| 18 | AA | 0.8 | 1.9 | 50 | −45 | 850 | 500 | 0.019 | 17 | GA | 10 |
| 19 | AA | 0.8 | 1.9 | 50 | −45 | 850 | 500 | 0.018 | 20 | GA | 10 |
| 20 | AA | 0.8 | 1.9 | 50 | −45 | 850 | 500 | 0.021 | 90 | GA | 10 |
| 21 | AA | 0.8 | 1.9 | 50 | −45 | 850 | 500 | 0.019 | 120 | GA | 10 |
| 22 | AA | 0.8 | 1.9 | 50 | −45 | 850 | 500 | 0.020 | 130 | GA | 10 |
| 23 | AB | 0.4 | 1.9 | 50 | −45 | 850 | 500 | 0.015 | 50 | GA | 10 |
| 24 | AC | 1.2 | 1.9 | 50 | −45 | 850 | 500 | 0.032 | 50 | GA | 10 |
| 25 | AD | 1.6 | 2.0 | 50 | −45 | 850 | 500 | 0.045 | 50 | GA | 10 |
| 26 | AE | 2.0 | 2.1 | 50 | −45 | 850 | 500 | 0.051 | 50 | GA | 10 |
| 27 | AF | 0.8 | 2.9 | 50 | −45 | 850 | 500 | 0.016 | 50 | GA | 10 |
| 28 | AG | 0.8 | 1.9 | 50 | −45 | 850 | 500 | 0.019 | 50 | GA | 10 |
| 29 | H | 0.1 | 2.1 | 50 | −45 | 850 | 500 | 0.015 | 50 | GA | 10 |
| 30 | AH | 0.8 | 2.1 | 50 | −45 | 850 | 500 | 0.018 | 50 | GA | 10 |
| 31 | AI | 0.8 | 2.1 | 50 | −45 | 850 | 500 | 0.020 | 50 | GA | 10 |
| 32 | AJ | 0.8 | 2.1 | 50 | −45 | 850 | 500 | 0.021 | 50 | GA | 10 |
| 33 | AK | 0.8 | 1.9 | 50 | −45 | 850 | 500 | 0.020 | 50 | GA | 10 |
| 34 | AL | 0.8 | 2.2 | 50 | −45 | 850 | 500 | 0.018 | 50 | GA | 10 |
| 35 | M | 0.1 | 2.0 | 50 | −45 | 850 | 500 | 0.015 | 50 | GA | 10 |
| 36 | AM | 0.8 | 2.0 | 50 | −45 | 850 | 500 | 0.017 | 50 | GA | 10 |
| 37 | AN | 0.8 | 2.1 | 50 | −45 | 850 | 500 | 0.019 | 50 | GA | 10 |
| 38 | AO | 0.8 | 2.1 | 50 | −45 | 850 | 500 | 0.021 | 50 | GA | 10 |
| 39 | AP | 0.8 | 1.9 | 50 | −45 | 850 | 500 | 0.021 | 50 | GA | 10 |
| 40 | AQ | 0.8 | 2.2 | 50 | −45 | 850 | 500 | 0.018 | 50 | GA | 10 |
| 41 | AR | 2.1 | 2.0 | 50 | −45 | 850 | 500 | 0.058 | 50 | GA | 10 |
| 42 | AS | 0.8 | 3.1 | 50 | −45 | 850 | 500 | 0.025 | 50 | GA | 10 |
| 43 | AT | 0.8 | 2.1 | 50 | −45 | 850 | 500 | 0.022 | 50 | GA | 10 |
| 44 | AU | 0.8 | 2.1 | 50 | −45 | 850 | 500 | 0.019 | 50 | GA | 10 |
| 45 | AV | 0.8 | 2.1 | 50 | −45 | 850 | 500 | 0.018 | 50 | GA | 10 |

| No. | Coating appear-ance | Corrosion resis-tance | Resistance to peeling of coating | TS (Mpa) | El (%) | TS × El | Work-ability | Remarks |
|---|---|---|---|---|---|---|---|---|
| 1 | ○ | ○ | ¤ | 650 | 38.0 | 24700 | Good | Example |
| 2 | x | x | x | 1055 | 15.5 | 16353 | Poor | Compar-ative Example |
| 3 | x | ○ | x | 1032 | 19.5 | 20124 | Good | Compar-ative Example |
| 4 | ○ | ○ | x | 1029 | 20.1 | 20683 | Good | Compar-ative Example |
| 5 | ○ | ○ | ○ | 1046 | 19.5 | 20397 | Good | Example |
| 6 | ○ | ○ | ¤ | 1040 | 20.5 | 21320 | Good | Example |
| 7 | ○ | ○ | ¤ | 1037 | 19.5 | 20222 | Good | Example |
| 8 | ○ | ○ | ¤ | 989 | 22.0 | 21758 | Good | Example |
| 9 | ○ | ○ | ¤ | 997 | 21.5 | 21436 | Good | Example |
| 10 | ○ | ○ | ¤ | 1012 | 19.5 | 19734 | Good | Example |
| 11 | ○ | ○ | ¤ | 1126 | 18.3 | 20606 | Good | Example |
| 12 | ○ | ○ | ○ | 1060 | 19.7 | 20882 | Good | Example |
| 13 | x | ○ | x | 1054 | 19.4 | 20448 | Good | Compar-ative Example |
| 14 | ○ | ○ | ○ | 995 | 22.1 | 21990 | Good | Example |
| 15 | ○ | ○ | ○ | 1049 | 20.1 | 21085 | Good | Example |
| 16 | ○ | ○ | ¤ | 1045 | 19.6 | 20482 | Good | Example |
| 17 | ○ | ○ | ¤ | 1060 | 18.6 | 19716 | Good | Example |
| 18 | ○ | x | ¤ | 1053 | 19.8 | 20849 | Good | Compar-ative Example |
| 19 | ○ | ○ | ¤ | 1061 | 20.6 | 21857 | Good | Example |
| 20 | ○ | ○ | ¤ | 1045 | 19.4 | 20273 | Good | Example |

TABLE 2-continued

| | | | | | | | | |
|---|---|---|---|---|---|---|---|---|
| 21 | ○ | ○ | ¤ | 1053 | 18.9 | 19902 | Good | Example |
| 22 | ○ | ○ | x | 1052 | 18.6 | 19567 | Good | Comparative Example |
| 23 | ○ | ○ | ¤ | 645 | 30.5 | 19673 | Good | Example |
| 24 | ○ | ○ | ¤ | 1261 | 15.4 | 19419 | Good | Example |
| 25 | ○ | ○ | ¤ | 1052 | 18.4 | 19357 | Good | Example |
| 26 | ○ | ○ | ¤ | 811 | 25.6 | 20762 | Good | Example |
| 27 | ○ | ○ | ¤ | 1054 | 21.6 | 22766 | Good | Example |
| 28 | ○ | ○ | ¤ | 1048 | 20.4 | 21379 | Good | Example |
| 29 | ○ | ○ | ¤ | 810 | 30.0 | 24300 | Good | Example |
| 30 | ○ | ○ | ¤ | 1063 | 19.5 | 20729 | Good | Example |
| 31 | ○ | ○ | ¤ | 1070 | 19.8 | 21186 | Good | Example |
| 32 | ○ | ○ | ¤ | 1064 | 19.9 | 21174 | Good | Example |
| 33 | ○ | ○ | ¤ | 1052 | 20.3 | 21356 | Good | Example |
| 34 | ○ | ○ | ¤ | 1057 | 20.1 | 21246 | Good | Example |
| 35 | ○ | ○ | ¤ | 690 | 33.0 | 22770 | Good | Example |
| 36 | ○ | ○ | ¤ | 1063 | 18.9 | 20091 | Good | Example |
| 37 | ○ | ○ | ¤ | 1064 | 20.8 | 22131 | Good | Example |
| 38 | ○ | ○ | ¤ | 1051 | 20.4 | 21440 | Good | Example |
| 39 | ○ | ○ | ¤ | 1049 | 20.3 | 21295 | Good | Example |
| 40 | ○ | ○ | ¤ | 1685 | 9.6 | 16176 | Poor | Comparative Example |
| 41 | x | ○ | x | 1067 | 19.7 | 21020 | Good | Comparative Example |
| 42 | ○ | ○ | x | 1080 | 16.4 | 17712 | Poor | Comparative Example |
| 43 | x | ○ | ¤ | 1072 | 19.3 | 20690 | Good | Comparative Example |
| 44 | x | ○ | x | 1049 | 17.0 | 17833 | Poor | Comparative Example |
| 45 | ○ | ○ | ¤ | 1055 | 16.5 | 17408 | Poor | Comparative Example |

As is evident from Table 2, regarding GI and GA (Examples) produced by our method, in spite of the fact that they are high-strength steel sheets containing large amounts of easily oxidizable elements, such as Si and Mn, corrosion resistance, workability, and resistance to peeling of coating during high-level work are excellent, and coating appearance is also good.

In contrast, in Comparative Examples, at least one of coating appearance, corrosion resistance, workability, and resistance to peeling of coating during high-level work is poor.

EXAMPLE 2

Hot-rolled steel sheets having steel compositions shown in Table 3 were each subjected to pickling to remove scales, and then subjected to cold rolling under the conditions shown in Table 4 to obtain cold-rolled steel sheets with a thickness of 1.0 mm.

TABLE 3

(mass %)

| Steel type | C | Si | Mn | Al | P | S | Cr | Mo | B | Nb | Cu | Ni | Ti |
|---|---|---|---|---|---|---|---|---|---|---|---|---|---|
| A | 0.05 | 0.03 | 2.0 | 0.03 | 0.01 | 0.004 | — | — | — | — | — | — | — |
| C | 0.15 | 0.1 | 2.1 | 0.03 | 0.01 | 0.004 | — | — | — | — | — | — | — |
| D | 0.05 | 0.25 | 2.0 | 0.03 | 0.01 | 0.004 | — | — | — | — | — | — | — |
| E | 0.05 | 0.39 | 2.1 | 0.03 | 0.01 | 0.004 | — | — | — | — | — | — | — |
| F | 0.05 | 0.1 | 2.9 | 0.03 | 0.01 | 0.004 | — | — | — | — | — | — | — |
| G | 0.05 | 0.1 | 2.0 | 0.9 | 0.01 | 0.004 | — | — | — | — | — | — | — |
| H | 0.05 | 0.1 | 2.1 | 0.03 | 0.05 | 0.004 | — | — | — | — | — | — | — |
| I | 0.05 | 0.1 | 1.9 | 0.03 | 0.01 | 0.009 | — | — | — | — | — | — | — |
| J | 0.05 | 0.1 | 1.9 | 0.02 | 0.01 | 0.004 | 0.8 | — | — | — | — | — | — |
| K | 0.05 | 0.1 | 1.9 | 0.03 | 0.01 | 0.004 | — | 0.1 | — | — | — | — | — |
| L | 0.05 | 0.1 | 2.2 | 0.03 | 0.01 | 0.004 | — | — | 0.003 | — | — | — | — |
| M | 0.05 | 0.1 | 2.0 | 0.05 | 0.01 | 0.004 | — | — | 0.001 | 0.03 | — | — | — |
| N | 0.05 | 0.1 | 1.9 | 0.03 | 0.01 | 0.004 | — | 0.1 | — | — | 0.1 | 0.2 | — |
| O | 0.05 | 0.1 | 1.9 | 0.04 | 0.01 | 0.004 | — | — | 0.001 | — | — | — | 0.02 |
| P | 0.05 | 0.1 | 1.9 | 0.03 | 0.01 | 0.004 | — | — | — | — | — | — | 0.05 |
| S | 0.02 | 0.1 | 3.1 | 0.03 | 0.01 | 0.004 | — | — | — | — | — | — | — |
| T | 0.02 | 0.1 | 1.9 | 1.1 | 0.01 | 0.004 | — | — | — | — | — | — | — |
| U | 0.02 | 0.1 | 1.9 | 0.03 | 0.07 | 0.004 | — | — | — | — | — | — | — |
| V | 0.02 | 0.1 | 1.9 | 0.03 | 0.01 | 0.02 | — | — | — | — | — | — | — |

Each of the resulting cold-rolled steel sheets was fed into a CGL equipped with an all radiant tube type heating furnace as an annealing furnace. In the CGL, as shown in Table 4, annealing was performed by passing the steel sheet through the annealing furnace while controlling the dew point in the annealing furnace temperature range of 600° C. or higher as shown in Table 4, and then a hot-dip galvanizing treatment was performed in an Al-containing Zn bath at 460° C.

The gas composition in the atmosphere included nitrogen, hydrogen, and unavoidable impurities, and the dew point was controlled by removing by absorption the moisture in the atmosphere. The hydrogen concentration in the atmosphere was basically set at 10 vol %.

Furthermore, a 0.14% Al-containing Zn bath was used for GA, and a 0.18% Al-containing Zn bath was used for GI. The coating weight was adjusted by gas wiping. Regarding GA, a galvannealing treatment was performed.

Appearance (coating appearance), corrosion resistance, and resistance to peeling of coating during high-level work, and workability were investigated for the resulting hot-dip galvanized steel sheets (GA and GI). Furthermore, the amount of oxides (amount of internal oxidation) present in the surface layer portion of the substrate steel sheet, up to a depth of 100 μm, directly below the coating layer was measured. Measurement methods and evaluation criteria are described below.

Appearance

The appearance was evaluated to be good (indicated by symbol ○) when defects, such as bare spots and uneven galvannealing, were not present. The appearance was evaluated to be poor (indicated by symbol x) when defects were present.

Corrosion Resistance

A salt spray test according to JIS Z 2371 (2000) was carried out for 3 days on a hot-dip galvannealed steel sheet with a size of 70 mm×150 mm. The corrosion product was removed by washing for one minute using chromic acid (concentration 200 g/L, 80° C.), and the coating corrosion weight loss ($g/m^2$·day) per surface before and after the test was measured by a weight method and evaluated on the basis of the following criteria:

○ (good): less than 20 $g/m^2$·day x (poor): 20 $g/m^2$·day or more.

Resistance to Peeling of Coating

Regarding the resistance to peeling of coating during high-level work, in GA, it is required to suppress peeling of coating at the bent spot when the coated steel sheet is bent at an acute angle with a bending angle exceeding 90°.

In this example, a cellophane tape was pressed against a working spot bent with a bending angle of 120° to transfer the peeled off pieces to the cellophane tape, and the amount of the peeled off pieces on the cellophane tape was measured as a count of Zn by a fluorescent x-ray method. In this process, the mask diameter was 30 mm, the accelerating voltage of fluorescent x-ray was 50 kV, the accelerating current was 50 mA, and the measurement time was 20 seconds. The count of Zn was classified into the following criteria. Ranks 1 and 2 were evaluated to have good resistance to peeling of coating (symbol ○), and Rank 3 or higher was evaluated to have poor resistance to peeling of coating (symbol x).

Fluorescent x-ray count of Zn: Rank 0 to less than 500: 1 (good)

500 to less than 1,000: 2

1,000 to less than 2,000: 3

2,000 to less than 3,000: 4

3,000 or more: 5 (poor)

In GI, resistance to peeling of coating in an impact test is required. A ball impact test was carried out, in which the working spot was subjected to tape peeling, and the presence or absence of peeling of the coating layer was visually determined. The ball impact conditions were as follows: ball weight, 1,000 g; and free fall drop height, 100 cm.

○: No peeling of coating layer x: Peeling of coating layer

Workability

Regarding workability, a JIS No. 5 tensile test piece was taken from a sample in a direction perpendicular to the rolling direction, and by performing a tensile test in accordance with JIS Z 2241 at a constant cross head speed of 10 mm/min, tensile strength (TS/MPa) and elongation (El %) were measured.

In the case where TS was less than 650 MPa, TS×El≥22,000 was evaluated to be good, and TS×El<22,000 was evaluated to be poor. In the case where TS was 650 MPa to less than 900 MPa, TS×El≥20,000 was evaluated to be good, and TS×El<20,000 was evaluated to be poor. In the case where TS was 900 MPa or more, TS×El≥18,000 was evaluated to be good, and TS×El<18,000 was evaluated to be poor.

Amount of Internal Oxidation in the Region Directly Below the Coating Layer up to a Depth of 100 μm The amount of internal oxidation was measured by an "impulse furnace fusion-infrared absorption method." It is necessary to subtract the amount of oxygen contained in the base material (i.e., the high-strength steel sheet before being subjected to annealing). Therefore, the surface portions at both sides of our high-strength steel sheet after continuous annealing were removed by a depth of 100 μm or more, and then the oxygen concentration in the steel was measured. The measured value was defined as the amount of oxygen contained in the base material (OH). The oxygen concentration in the steel was also measured for the high-strength steel sheet after continuous annealing over the entire thickness of the steel sheet, and the measured value was defined as the amount of oxygen after internal oxidation (OI). Using the amount of oxygen in the high-strength steel sheet after internal oxidation (OI) and the amount of oxygen contained in the base material (OH), a difference between OI and OH (=OI−OH) was calculated, and the resulting value was converted to a value per unit area of one surface (i.e., 1 $m^2$), which was defined as the amount of internal oxidation ($g/m^2$).

The results obtained as described above are shown in Table 4 together with the production conditions.

TABLE 4

| | Steel | | | Production method | | | | | | | |
|---|---|---|---|---|---|---|---|---|---|---|---|
| | | | | | Annealing furnace | | | | | | |
| No. | Type | Si mass % | Mn mass % | Cold rolling reduction ratio (%) | Dew point at 600° C. or higher (° C.) | Highest achieving temperature (° C.) | Galvannealing temperature (° C.) | Amount of internal oxidation ($g/m^2$) | Coating weight ($g/m^2$) | Coating type | Fe content in coating layer (mass %) |
| 1 | A | 0.03 | 2.0 | 50 | −25 | 850 | 500 | 0.078 | 40 | GA | 10 |
| 2 | A | 0.03 | 2.0 | 50 | −35 | 850 | 500 | 0.023 | 40 | GA | 10 |
| 3 | A | 0.03 | 2.0 | 50 | −39 | 850 | 500 | 0.020 | 40 | GA | 10 |

TABLE 4-continued

| | | | | | | | | | | | |
|---|---|---|---|---|---|---|---|---|---|---|---|
| 4 | A | 0.03 | 2.0 | 50 | −40 | 850 | 500 | 0.015 | 40 | GA | 10 |
| 5 | A | 0.03 | 2.0 | 50 | −45 | 850 | 500 | 0.004 | 40 | GA | 10 |
| 6 | A | 0.03 | 2.0 | 50 | −60 | 850 | 500 | 0.002 | 40 | GA | 10 |
| 8 | A | 0.03 | 2.0 | 50 | −45 | 750 | 500 | 0.002 | 40 | GA | 10 |
| 9 | A | 0.03 | 2.0 | 50 | −45 | 800 | 500 | 0.003 | 40 | GA | 10 |
| 10 | A | 0.03 | 2.0 | 50 | −45 | 900 | 500 | 0.006 | 40 | GA | 10 |
| 11 | A | 0.03 | 2.0 | 50 | −45 | 850 | Not galvan-nealed | 0.004 | 40 | GI | 1 |
| 12 | A | 0.03 | 2.0 | 50 | −35 | 850 | Not galvan-nealed | 0.022 | 40 | GI | 1 |
| 14 | A | 0.03 | 2.0 | 50 | −60 | 850 | Not galvan-nealed | 0.001 | 40 | GI | 1 |
| 15 | A | 0.03 | 2.0 | 50 | −45 | 850 | 460 | 0.003 | 40 | GA | 8 |
| 16 | A | 0.03 | 2.0 | 50 | −45 | 850 | 550 | 0.004 | 40 | GA | 13 |
| 17 | A | 0.03 | 2.0 | 50 | −45 | 850 | 500 | 0.005 | 16 | GA | 10 |
| 18 | A | 0.03 | 2.0 | 50 | −45 | 850 | 500 | 0.004 | 20 | GA | 10 |
| 19 | A | 0.03 | 2.0 | 50 | −45 | 850 | 500 | 0.004 | 80 | GA | 10 |
| 20 | A | 0.03 | 2.0 | 50 | −45 | 850 | 500 | 0.004 | 120 | GA | 10 |
| 21 | A | 0.03 | 2.0 | 50 | −45 | 850 | 500 | 0.003 | 140 | GA | 10 |
| 23 | C | 0.1 | 2.1 | 50 | −45 | 850 | 500 | 0.009 | 40 | GA | 10 |
| 24 | D | 0.25 | 2.0 | 50 | −45 | 850 | 500 | 0.012 | 40 | GA | 10 |
| 25 | E | 0.39 | 2.1 | 50 | −45 | 850 | 500 | 0.019 | 40 | GA | 10 |
| 26 | F | 0.1 | 2.9 | 50 | −45 | 850 | 500 | 0.008 | 40 | GA | 10 |
| 27 | G | 0.1 | 2.0 | 50 | −45 | 850 | 500 | 0.009 | 40 | GA | 10 |
| 28 | H | 0.1 | 2.1 | 50 | −45 | 850 | 500 | 0.007 | 40 | GA | 10 |
| 29 | I | 0.1 | 1.9 | 50 | −45 | 850 | 500 | 0.009 | 40 | GA | 10 |
| 30 | J | 0.1 | 1.9 | 50 | −45 | 850 | 500 | 0.011 | 40 | GA | 10 |
| 31 | K | 0.1 | 1.9 | 50 | −45 | 850 | 500 | 0.010 | 40 | GA | 10 |
| 32 | L | 0.1 | 2.2 | 50 | −45 | 850 | 500 | 0.009 | 40 | GA | 10 |
| 33 | M | 0.1 | 2.0 | 50 | −45 | 850 | 500 | 0.008 | 40 | GA | 10 |
| 34 | N | 0.1 | 1.9 | 50 | −45 | 850 | 500 | 0.010 | 40 | GA | 10 |
| 35 | O | 0.1 | 1.9 | 50 | −45 | 850 | 500 | 0.011 | 40 | GA | 10 |
| 36 | P | 0.1 | 1.9 | 50 | −45 | 850 | 500 | 0.010 | 40 | GA | 10 |
| 39 | S | 0.1 | 3.1 | 50 | −45 | 850 | 500 | 0.010 | 40 | GA | 10 |
| 40 | T | 0.1 | 1.9 | 50 | −45 | 850 | 500 | 0.011 | 40 | GA | 10 |
| 41 | U | 0.1 | 1.9 | 50 | −45 | 850 | 500 | 0.009 | 40 | GA | 10 |
| 42 | V | 0.1 | 1.9 | 50 | −45 | 850 | 500 | 0.008 | 40 | GA | 10 |

| No. | Coating appear-ance | Corrosion resis-tance | Resistance to peeling of coating | TS (Mpa) | El (%) | TS × El | Work-ability | Remarks |
|---|---|---|---|---|---|---|---|---|
| 1 | x | x | x | 645 | 23.6 | 15222 | Poor | Compar-ative Example |
| 2 | x | ○ | x | 638 | 35.6 | 22713 | Good | Compar-ative Example |
| 3 | x | ○ | ○ | 645 | 38.9 | 25091 | Good | Compar-ative Example |
| 4 | ○ | ○ | ○ | 650 | 37.0 | 24050 | Good | Example |
| 5 | ○ | ○ | ○ | 655 | 37.2 | 24366 | Good | Example |
| 6 | ○ | ○ | ○ | 648 | 38.5 | 24948 | Good | Example |
| 8 | ○ | ○ | ○ | 638 | 38.2 | 24372 | Good | Example |
| 9 | ○ | ○ | ○ | 634 | 37.8 | 23965 | Good | Example |
| 10 | ○ | ○ | ○ | 633 | 37.7 | 23864 | Good | Example |
| 11 | ○ | ○ | ○ | 666 | 36.9 | 24575 | Good | Example |
| 12 | x | ○ | x | 670 | 37.1 | 24857 | Good | Compar-ative Example |
| 14 | ○ | ○ | ○ | 659 | 37.2 | 24515 | Good | Example |
| 15 | ○ | ○ | ○ | 653 | 37.8 | 24683 | Good | Example |
| 16 | ○ | ○ | ○ | 659 | 36.9 | 24317 | Good | Example |
| 17 | ○ | ○ | x | 650 | 37.0 | 24050 | Good | Compar-ative Example |
| 18 | ○ | ○ | ○ | 662 | 37.2 | 24626 | Good | Example |
| 19 | ○ | ○ | ○ | 657 | 37.8 | 24835 | Good | Example |
| 20 | ○ | ○ | ○ | 653 | 36.9 | 24096 | Good | Example |
| 21 | ○ | ○ | x | 658 | 37.4 | 24609 | Good | Compar-ative Example |
| 23 | ○ | ○ | ○ | 799 | 30.2 | 24130 | Good | Example |
| 24 | ○ | ○ | ○ | 661 | 43.7 | 28886 | Good | Example |
| 25 | ○ | ○ | ○ | 669 | 44.9 | 30038 | Good | Example |
| 26 | ○ | ○ | ○ | 698 | 33.6 | 23453 | Good | Example |

TABLE 4-continued

| | | | | | | | | |
|---|---|---|---|---|---|---|---|---|
| 27 | ○ | ○ | ○ | 669 | 34.6 | 23147 | Good | Example |
| 28 | ○ | ○ | ○ | 811 | 29.6 | 24006 | Good | Example |
| 29 | ○ | ○ | ○ | 670 | 36.1 | 24187 | Good | Example |
| 30 | ○ | ○ | ○ | 664 | 35.0 | 23240 | Good | Example |
| 31 | ○ | ○ | ○ | 699 | 33.6 | 23486 | Good | Example |
| 32 | ○ | ○ | ○ | 690 | 33.7 | 23253 | Good | Example |
| 33 | ○ | ○ | ○ | 695 | 32.3 | 22449 | Good | Example |
| 34 | ○ | ○ | ○ | 685 | 33.7 | 23085 | Good | Example |
| 35 | ○ | ○ | ○ | 666 | 35.1 | 23377 | Good | Example |
| 36 | ○ | ○ | ○ | 655 | 36.1 | 23646 | Good | Example |
| 39 | x | ○ | x | 710 | 34.5 | 24495 | Good | Comparative Example |
| 40 | x | ○ | ○ | 659 | 35.1 | 23131 | Good | Comparative Example |
| 41 | x | ○ | x | 892 | 22.1 | 19713 | Poor | Comparative Example |
| 42 | ○ | ○ | ○ | 663 | 25.8 | 17105 | Poor | Comparative Example |

As is evident from Table 4, regarding GI and GA (Examples) produced by our method, in spite of the fact that they are high-strength steel sheets containing large amounts of easily oxidizable elements, such as Si and Mn, corrosion resistance, workability, and resistance to peeling of coating during high-level work are excellent, and coating appearance is also good.

In contrast, in Comparative Examples, at least one of coating appearance, corrosion resistance, workability, and resistance to peeling of coating during high-level work is poor.

INDUSTRIAL APPLICABILITY

High-strength hot-dip galvanized steel sheets have excellent coating appearance, corrosion resistance, workability, and resistance to peeling of coating during high-level work, and can be used as surface-treated steel sheets for decreasing the weight of and increasing the strength of automobile bodies. Furthermore, other than automobiles, the high-strength hot-dip galvanized steel sheets can be used as surface-treated steel sheets produced by imparting rust-preventive properties to base material steel sheets in the wide fields, such as household appliances and building materials.

The invention claimed is:

1. A method for producing a high-strength hot-dip galvanized steel sheet including a steel sheet containing, in percent by mass, 0.01% to 0.18% of C, 0.02% to 2.0% of Si, 1.0% to 3.0% of Mn, 0.001% to 1.0% of Al, 0.005% to 0.060% of P, 0.01% or less of S, and the balance being Fe and incidental impurities, and a galvanized coating layer on each surface of the steel sheet with a coating weight of 20 to 120 g/m$^2$ per surface, the method comprising, when the steel sheet is subjected to annealing and a hot-dip galvanizing treatment in a continuous hot-dip galvanizing line, controlling a dew point of the atmosphere to −40° C. or lower in every a region of the annealing furnace that has a temperature range higher than 780° C.

2. The method according to claim 1, wherein the steel sheet further contains, as a component, in percent by mass, at least one element selected from the group consisting of 0.001% to 0.005% of B, 0.005% to 0.05% of Nb, 0.005% to 0.05% of Ti, 0.001% to 1.0% of Cr, 0.05% to 1.0% of Mo, 0.05% to 1.0% of Cu, and 0.05% to 1.0% of Ni.

3. The method according to claim 1, wherein, after the hot-dip galvanizing treatment, the steel sheet is subjected to a galvannealing treatment by heating to a temperature of 450° C. to 600° C. so that Fe content in the galvanized coating layer is in the range of 7% to 15% by mass.

4. The method according to claim 2, wherein, after the hot-dip galvanizing treatment, the steel sheet is subjected to a galvannealing treatment by heating to a temperature of 450° C. to 600° C. so that Fe content in the galvanized coating layer is in the range of 7% to 15% by mass.

5. A method for producing a high-strength hot-dip galvanized steel sheet including a steel sheet containing, in percent by mass, 0.01% to 0.18% of C, 0.02% to 2.0% of Si, 1.0% to 3.0% of Mn, 0.001% to 1.0% of Al, 0.005% to 0.060% of P, 0.01% or less of S, and the balance being Fe and incidental impurities, and a galvanized coating layer on each surface of the steel sheet with a coating weight of 20 to 120 g/m$^2$ per surface, the method comprising, when the steel sheet is subjected to annealing and a hot-dip galvanizing treatment in a continuous hot-dip galvanizing line, controlling a dew point of the atmosphere to −40° C. or lower in a region of the annealing furnace that has a temperature range higher than 780° C. during the annealing and hot-dip galvanizing treatment such that the amount of at least one oxide selected from oxides of Fe, Si, Mn, Al, P, B, Nb, Ti, Cr, Mo, Cu, and Ni, formed in the surface layer portion of the steel sheet, within 100 μm from the surface of the substrate steel sheet, directly below the galvanized coating layer, is 0.060 g/m$^2$ or less per surface.

6. A method for producing a high-strength hot-dip galvanized steel sheet including a steel sheet containing, in percent by mass, 0.01% to 0.18% of C, 0.02% to 2.0% of Si, 1.0% to 3.0% of Mn, 0.001% to 1.0% of Al, 0.005% to 0.060% of P, 0.01% or less of S, and the balance being Fe and incidental impurities, and a galvanized coating layer on each surface of the steel sheet with a coating weight of 20 to 120 g/m$^2$ per surface, the method comprising, when the steel sheet is subjected to annealing and a hot-dip galvanizing treatment in a continuous hot-dip galvanizing line, controlling a dew point of the atmosphere to −45° C. or lower in a region of the annealing furnace that has a temperature range higher than 780° C. during a heating step and a soaking step of the annealing and hot-dip galvanizing treatment.

* * * * *